US008608017B2

(12) United States Patent
Connors, Jr. et al.

(10) Patent No.: US 8,608,017 B2
(45) **Date of Patent: *Dec. 17, 2013**

(54) DRINKING CONTAINERS

(75) Inventors: James A. Connors, Jr., Upton, MA (US); David E. Medeiros, Plainville, MA (US); George S. Dys, Mapleville, RI (US); James J. Britto, Westport, MA (US); John A. Hession, Braintree, MA (US)

(73) Assignee: Learning Curve Brands, Inc., Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/682,848

(22) Filed: Mar. 6, 2007

(65) Prior Publication Data

US 2007/0145058 A1 Jun. 28, 2007

Related U.S. Application Data

(60) Division of application No. 10/819,245, filed on Apr. 5, 2004, now Pat. No. 7,185,784, which is a continuation of application No. PCT/US02/31875, filed on Oct. 4, 2002, which is a continuation-in-part of application No. 09/971,499, filed on Oct. 5, 2001, now Pat. No. 6,976,604.

(51) Int. Cl.
*A47G 19/22* (2006.01)

(52) U.S. Cl.
USPC ..... 220/713; 220/711; 215/387

(58) Field of Classification Search
USPC ..... 220/719, 711, 713, 714; 215/387, 260, 215/311
See application file for complete search history.

(56) References Cited

U.S. PATENT DOCUMENTS

| | | | |
|---|---|---|---|
| 2,534,614 | A | 12/1950 | Michael |
| 2,623,368 | A | 12/1952 | Olsen |
| 2,630,944 | A | 3/1953 | Wheaton |
| 2,833,324 | A | 9/1955 | Burroughs |

(Continued)

FOREIGN PATENT DOCUMENTS

| | | |
|---|---|---|
| DE | 595116 | 3/1934 |
| DE | 1955162 | 5/1971 |

(Continued)

OTHER PUBLICATIONS

Complaint for Patent Infringement; *The First Years Inc. and Learning Curve Brands, Inc.* v. *Munchkin, Inc.*; Case No. 07-C-0558-C; Oct. 5, 2007.

Answer, Defenses and Counterclaims of Defendant Munchkin, Inc.; *The First Years Inc. and Learning Curve Brands, Inc.* v. *Munchkin, Inc.*; Case No. 07-C-0558-C; Nov. 27, 2007.

(Continued)

*Primary Examiner* — Anthony Stashick
*Assistant Examiner* — Christopher McKinley
(74) *Attorney, Agent, or Firm* — Michael Best & Friedrich LLP

(57) ABSTRACT

A disposable child's drinking cup has a lid with a drinking spout defining multiple open holes sized to resist leakage in the absence of suction, such as by the development of surface tension at the holes, and to allow flow when suction is applied. The holes are formed during molding of the lid. An inner contour of a groove of the lid and an outer contour of the cup body rim are selected to provide a slight snap fit of the lid onto the cup body, to provide a secure seal.

20 Claims, 10 Drawing Sheets

(56) References Cited

U.S. PATENT DOCUMENTS

| | | | | | |
|---|---|---|---|---|---|
| 2,765,639 | A | | 10/1956 | Bryant | |
| D165,778 | S | | 1/1958 | Olson | |
| 3,048,317 | A | | 8/1962 | Cochrane et al. | |
| 3,301,459 | A | | 1/1967 | Gardner | |
| 3,335,774 | A | | 8/1967 | Reed | |
| 3,424,342 | A | | 1/1969 | Scopp et al. | |
| 3,447,714 | A | | 6/1969 | Elliot | |
| 3,448,888 | A | | 6/1969 | Smith et al. | |
| 3,452,896 | A | | 7/1969 | Elliot | |
| D215,413 | S | | 9/1969 | Donovan | |
| 3,596,694 | A | | 8/1971 | Jaeniche | |
| 3,628,704 | A | * | 12/1971 | Corsette | 222/513 |
| 3,679,088 | A | | 7/1972 | Swett et al. | |
| 3,692,208 | A | | 9/1972 | Croyle et al. | |
| 3,722,731 | A | | 3/1973 | McCormick et al. | |
| 3,730,382 | A | | 5/1973 | Heisler | |
| 3,773,207 | A | | 11/1973 | Dokoupil | |
| 3,805,991 | A | | 4/1974 | Cheladze et al. | |
| 3,817,420 | A | | 6/1974 | Heisler | |
| 3,864,763 | A | * | 2/1975 | Spransy | 4/227.5 |
| 3,895,739 | A | * | 7/1975 | Buchtel | 222/57 |
| 3,895,743 | A | | 7/1975 | Christian | |
| 3,938,695 | A | | 2/1976 | Ruff | |
| 3,977,563 | A | | 8/1976 | Holt | |
| 4,085,861 | A | | 4/1978 | Ruff | |
| 4,146,157 | A | | 3/1979 | Dixon et al. | |
| 4,177,932 | A | | 12/1979 | Cleevely | |
| 4,243,156 | A | * | 1/1981 | Lobbestael | 222/541.6 |
| 4,256,240 | A | | 3/1981 | Woinarski | |
| D259,231 | S | * | 5/1981 | Kozlow, Sr. | D7/392.1 |
| 4,303,170 | A | | 12/1981 | Panicci | |
| 4,308,970 | A | | 1/1982 | Von Holdt | |
| 4,350,260 | A | | 9/1982 | Prueher | |
| 4,373,642 | A | | 2/1983 | Wolters et al. | |
| 4,388,996 | A | | 6/1983 | Panicci | |
| D272,595 | S | | 2/1984 | Chase et al. | |
| 4,444,332 | A | | 4/1984 | Widen et al. | |
| 4,446,986 | A | | 5/1984 | Bowen et al. | |
| 4,474,305 | A | | 10/1984 | Marco | |
| D280,600 | S | | 9/1985 | Earl | |
| 4,553,686 | A | * | 11/1985 | Dougherty | 222/212 |
| 4,589,569 | A | | 5/1986 | Clements | |
| 4,600,111 | A | | 7/1986 | Brown | |
| D285,906 | S | | 9/1986 | Tyler | |
| 4,619,372 | A | | 10/1986 | McFarland | |
| 4,640,435 | A | | 2/1987 | Dutt | |
| 4,742,935 | A | | 5/1988 | Schellenberg | |
| 4,756,440 | A | * | 7/1988 | Gartner | 220/711 |
| 4,787,530 | A | | 11/1988 | Edwards | |
| 4,819,824 | A | | 4/1989 | Longbottom et al. | |
| 4,828,141 | A | * | 5/1989 | Coy | 220/380 |
| 4,850,496 | A | | 7/1989 | Rudell et al. | |
| 4,872,586 | A | | 10/1989 | Landis | |
| 4,899,902 | A | | 2/1990 | DeMars | |
| 4,946,062 | A | | 8/1990 | Coy | |
| 4,961,510 | A | * | 10/1990 | Dvoracek | 220/713 |
| D313,556 | S | | 1/1991 | Smith | |
| 4,986,437 | A | | 1/1991 | Farmer | |
| 5,035,320 | A | | 7/1991 | Plone | |
| 5,050,759 | A | | 9/1991 | Marble | |
| 5,147,066 | A | | 9/1992 | Snider | |
| 5,169,026 | A | | 12/1992 | Patterson | |
| 5,186,347 | A | * | 2/1993 | Freeman et al. | 220/254.1 |
| D334,114 | S | | 3/1993 | Narsutis | |
| D336,850 | S | | 6/1993 | Guillin | |
| 5,219,101 | A | * | 6/1993 | Matkovich et al. | 222/189.06 |
| 5,253,781 | A | | 10/1993 | Van Melle et al. | |
| 5,363,983 | A | * | 11/1994 | Proshan | 220/717 |
| 5,366,109 | A | * | 11/1994 | Proshan | 220/717 |
| 5,377,860 | A | | 1/1995 | Littlejohn et al. | |
| D359,417 | S | | 6/1995 | Chen | |
| 5,433,338 | A | | 7/1995 | Proshan | |
| 5,529,202 | A | | 6/1996 | Shamis | |
| 5,538,156 | A | | 7/1996 | Proshan | |
| 5,540,350 | A | | 7/1996 | Lansky | |
| 5,624,051 | A | | 4/1997 | Ahern, Jr. et al. | |
| D379,431 | S | | 5/1997 | Mangla | |
| D388,325 | S | | 12/1997 | Tucker et al. | |
| D390,109 | S | | 2/1998 | Tucker et al. | |
| D397,906 | S | | 9/1998 | Briggs et al. | |
| 5,839,581 | A | * | 11/1998 | Vagedes | 206/459.1 |
| 5,868,272 | A | | 2/1999 | Deal | |
| 5,881,893 | A | | 3/1999 | Manganiello | |
| 5,890,620 | A | | 4/1999 | Belcastro | |
| 5,890,621 | A | | 4/1999 | Bachman et al. | |
| 5,893,472 | A | | 4/1999 | Forrer | |
| 5,894,952 | A | | 4/1999 | Mendenhall et al. | |
| 5,979,690 | A | | 11/1999 | Hartley | |
| 5,988,425 | A | * | 11/1999 | Yehl et al. | 220/303 |
| 6,032,827 | A | | 3/2000 | Zettle et al. | |
| 6,050,445 | A | | 4/2000 | Manganiello | |
| 6,102,245 | A | | 8/2000 | Haberman | |
| 6,116,457 | A | | 9/2000 | Haberman | |
| 6,168,044 | B1 | | 1/2001 | Zettle et al. | |
| 6,170,696 | B1 | | 1/2001 | Tucker | |
| 6,196,404 | B1 | | 3/2001 | Chen | |
| 6,230,923 | B1 | * | 5/2001 | Hung | 220/703 |
| 6,321,931 | B1 | | 11/2001 | Hakim et al. | |
| 6,357,620 | B1 | | 3/2002 | Hakim | |
| 6,419,112 | B1 | | 7/2002 | Bruce et al. | |
| 6,422,415 | B1 | | 7/2002 | Manganiello | |
| 6,460,716 | B1 | | 10/2002 | Wong | |
| 6,523,712 | B1 | * | 2/2003 | McGushion | 220/713 |
| 6,571,981 | B2 | * | 6/2003 | Rohlfs | 220/713 |
| 6,629,624 | B2 | | 10/2003 | Stillinger et al. | |
| 6,631,823 | B2 | | 10/2003 | Stillinger et al. | |
| 6,732,882 | B2 | | 5/2004 | Belcastro | |
| 6,733,852 | B2 | | 5/2004 | Littlejohn et al. | |
| 6,745,915 | B2 | * | 6/2004 | Rees | 220/714 |
| 6,758,364 | B1 | | 7/2004 | Rohrig | |
| 6,786,352 | B2 | * | 9/2004 | Belcastro | 220/714 |
| RE38,692 | E | | 2/2005 | Wong | |
| 6,880,713 | B2 | * | 4/2005 | Holley, Jr. | 215/11.4 |
| 6,883,677 | B2 | | 4/2005 | Goeking et al. | |
| 6,942,121 | B1 | | 9/2005 | Northup et al. | |
| 6,976,604 | B2 | | 12/2005 | Connors, Jr. et al. | |
| 6,991,122 | B2 | * | 1/2006 | Holley, Jr. | 215/11.4 |
| 6,994,225 | B2 | | 2/2006 | Hakim | |
| 7,185,784 | B2 | | 3/2007 | Connors, Jr. et al. | |
| 7,735,674 | B2 | | 6/2010 | Cai | |
| 2002/0037378 | A1 | | 3/2002 | Littlejohn et al. | |
| 2002/0148846 | A1 | | 10/2002 | Luburic | |
| 2002/0158075 | A1 | * | 10/2002 | Caldicott et al. | 220/714 |
| 2002/0162846 | A1 | | 11/2002 | Mercier | |
| 2003/0057207 | A1 | | 3/2003 | Wong | |
| 2004/0000551 | A1 | * | 1/2004 | Flink et al. | 220/258.3 |
| 2004/0200849 | A1 | * | 10/2004 | Goeking et al. | 220/713 |
| 2004/0232154 | A1 | * | 11/2004 | Smith et al. | 220/713 |
| 2005/0087539 | A1 | * | 4/2005 | Waller | 220/713 |
| 2005/0155973 | A1 | * | 7/2005 | Goeking et al. | 220/717 |
| 2006/0060590 | A1 | | 3/2006 | Goeking et al. | |
| 2006/0243734 | A1 | * | 11/2006 | Tedford, Jr. | 220/780 |
| 2006/0261064 | A1 | * | 11/2006 | Holley, Jr. | 220/203.06 |
| 2007/0095846 | A1 | * | 5/2007 | Goecke et al. | 220/780 |
| 2008/0073347 | A1 | * | 3/2008 | Shadrach | 220/254.9 |

FOREIGN PATENT DOCUMENTS

| | | |
|---|---|---|
| DE | 8518647.3 | 9/1985 |
| DE | 29909423 | 12/1999 |
| EP | 0298247 | 1/1989 |
| EP | 0408516 | 1/1991 |
| GB | 165346 | 9/1969 |
| GB | 2136775 | 9/1984 |
| GB | 2257118 | 1/1993 |
| GB | 2285621 | 7/1995 |
| JP | 7033167 | 2/1995 |
| JP | 10201596 | 8/1998 |
| WO | 9007291 | 7/1990 |
| WO | 9615042 | 5/1996 |
| WO | 9637134 | 11/1996 |
| WO | WO 97/17005 | 5/1997 |
| WO | 9967146 | 12/1999 |
| WO | 9967147 | 12/1999 |

(56) References Cited

FOREIGN PATENT DOCUMENTS

| | | |
|---|---|---|
| WO | 9967148 | 12/1999 |
| WO | 0112031 | 2/2001 |
| WO | 03030695 | 4/2003 |

OTHER PUBLICATIONS

Munchkin, Inc.'s Opening Claim Construction Brief; *The First Years Inc. and Learning Curve Brands, Inc.* v. *Munchkin, Inc.*; Case No. 07-C-0558-C; Feb. 8, 2008.

Plaintiffs' Claim Construction Brief; *The First Years Inc. and Learning Curve Brands, Inc.* v. *Munchkin, Inc.*; Case No. 07-C-0558-C; Feb. 8, 2008.

Declaration of Patricia L. Kusenberger in Support of Plaintiffs' Claim Construction Brief with Exhibits C-G, I-P; *The First Years Inc. and Learning Curve Brands, Inc.* v. *Munchkin, Inc.*; Case No. 07-C-0558-C; Feb. 8, 2008.

Declaration of Tim A. Osswald, Ph.D with Exhibit 1; *The First Years Inc. and Learning Curve Brands, Inc.* v. *Munchkin, Inc.*; Case No. 07-C-0558-C; Feb. 8, 2008.

Declaration of John L. Knoble in Support of Munchkin's Opening Claim Construction Brief with Exhibits 5-9, 12, 14-18; *The First Years Inc. and Learning Curve Brands, Inc.* v. *Munchkin, Inc.*; Case No. 07-C-0558-C; Feb. 8, 2008.

Munchkin, Inc's Response to Plaintiffs' Claim Construction Brief; *The First Years Inc. and Learning Curve Brands, Inc.* v. *Munchkin, Inc.*; Case No. 07-C-0558-C; Feb. 22, 2008.

Declaration of Timothy A. Shedd with Exhibits A-G; *The First Years Inc. and Learning Curve Brands, Inc.* v. *Munchkin, Inc.*; Case No. 07-C-0558-C; Feb. 22, 2008.

Plaintiffs' Claim Construction Response Brief; *The First Years Inc. and Learning Curve Brands, Inc.* v. *Munchkin, Inc.*; Case No. 07-C-0558-C; Feb. 22, 2008.

Feb. 22, 2008 Declaration of Patricia L. Kusenberger in Support of Plaintiffs' Claim Construction Response Brief with Exhibits A-B; *The First Years Inc. and Learning Curve Brands, Inc.* v. *Munchkin, Inc.*; Case No. 07-C-0558-C; Feb. 22, 2008.

Amended Answer, Defenses and Counterclaims of Defendant Munchkin, Inc.; *The First Years Inc. and Learning Curve Brands, Inc.* v. *Munchkin, Inc.*; Case No. 07-C-0558-C; Feb. 25, 2008.

Plaintiffs' Reply to Defendant's Amended Counterclaims; *The First Years Inc. and Learning Curve Brands, Inc.* v. *Munchkin, Inc.*; Case No. 07-C-0558-C; Mar. 10, 2008.

Opinion and Order by the Court on Claim Construction; *The First Years Inc. and Learning Curve Brands, Inc.* v. *Munchkin, Inc.*; Case No. 07-C-0558-C; Apr. 16, 2008.

Expert Report of Tim A. Osswald, Ph.D. with Exhibits 1-4; *The First Years Inc. and Learning Curve Brands, Inc.* v. *Munchkin, Inc.*; Case No. 07-C-0558-C; Apr. 18, 2008.

Expert Report of Albert V. Karvelis, Ph.D., P.E. with Appendices A-1; *The First Years Inc. and Learning Curve Brands, Inc.* v. *Munchkin, Inc.*; Case No. 07-C-0558-C; Apr. 18, 2008.

Expert Report of Timothy A. Shedd; *The First Years Inc. and Learning Curve Brands, Inc.* v. *Munchkin, Inc.*; Case No. 07-C-0558-C; Apr. 18, 2008.

Plaintiffs' Brief in Support of Their Motion for Reconsideration in Part of the Court's Apr. 15, 2008 Claim Construction Order; *The First Years Inc. and Learning Curve Brands, Inc.* v. *Munchkin, Inc.*; Case No. 07-C-0558-C; Apr. 29, 2008.

Defendant's Brief in Response to Plaintiffs' Motion for Reconsideration; *The First Years Inc. and Learning Curve Brands, Inc.* v. *Munchkin, Inc.*; Case No. 07-C-0558-C; May 5, 2008.

Opinion and Order by the Court; *The First Years Inc. and Learning Curve Brands, Inc.* v. *Munchkin, Inc.*; Case No. 07-C-0558-C; May 13, 2008.

Rebuttal Report of Timothy A. Shedd with Exhibits C-E; *The First Years Inc. and Learning Curve Brands, Inc.* v. *Munchkin, Inc.*; Case No. 07-C-0558-C; May 30, 2008.

Responsive Expert Report of Tim A. Osswald, Ph.D.; *The First Years Inc. and Learning Curve Brands, Inc.* v. *Munchkin, Inc.*; Case No. 07-C-0558-C; May 30, 2008.

Defendant Munchkin, Inc.'s Motion for Partial Summary Judgment of Invalidity and Noninfringement of the Claims of U.S. Patents No. 6,976,604 B1 and 7,185,784 B1; *The First Years Inc. and Learning Curve Brands, Inc.* v. *Munchkin, Inc.*; Case No. 07-C-0558-C; Jun. 6, 2008.

Memorandum in Support of Defendant Munchkin, Inc.'s Motion for Partial Summary Judgment of Invalidity and Noninfringement of the Claims of U.S. Patents No. 6,976,604 B1 and 7,185,784 B1 and for the Unenforceability of U.S. Patent No. 7,185,784 B1; *The First Years Inc. and Learning Curve Brands, Inc.* v. *Munchkin, Inc.*; Case No. 07C-0558-C; Jun. 6, 2008.

Declaration of William J. Gartner with Exhibits 1-7; *The First Years Inc. and Learning Curve Brands, Inc.* v. *Munchkin, Inc.*; Case No. 07-C-0558-C; Feb. 22, 2008.

TFY's Brief in Support of its Motion for Summary Judgment of Infringement; *The First Years Inc. and Learning Curve Brands, Inc.* v. *Munchkin, Inc.*; Case No. 07-C-0558-C; Jun. 6, 2008.

TFY's Brief in Support of its Motion for Partial Summary Judgment of Validity of U.S. Patent No. 6,976,604; *The First Years Inc. and Learning Curve Brands, Inc.* v. *Munchkin, Inc.*; Case No. 07-C-0558-C; Jun. 6, 2008.

TFY's Brief in Support of its Motion for Summary Judgment of No Inequitable Conduct; *The First Years Inc. and Learning Curve Brands, Inc.* v. *Munchkin, Inc.*; Case No. 07-C-0558-C; Jun. 6, 2008.

Declaration of Tim A. Osswald, Ph.D. in Support of Plaintiffs' Motion for Summary Judgment of Infringement with Appendix A; *The First Years Inc. and Learning Curve Brands, Inc.* v. *Munchkin, Inc.*; Case No. 07-C-0558-C; Jun. 6, 2008.

Declaration of Albert V. Karvelis in Support of Plaintiffs' Motion for Summary Judgment of Infringement with Exhibits C-I; *The First Years Inc. and Learning Curve Brands, Inc.* v. *Munchkin, Inc.*; Case No. 07-C-0558-C; Jun. 6, 2008.

Deposition of David Medeiros taken Jun. 10, 2008 with Exhibits 13 and 15-17; *The First Years Inc. and Learning Curve Brands, Inc.* v. *Munchkin, Inc.*; Case No. 07-C-0558-C; Jun. 27, 2008.

Defendant's Response to TFY's Motion for Summary Judgment of No Inequitable Conduct; *The First Years Inc. and Learning Curve Brands, Inc.* v. *Munchkin, Inc.*; Case No. 07-C-0558-C; Jun. 27, 2008.

Munchkin's Brief in Opposition to TFY's Motion for Summary Judgment of Infringement of U.S. Patents Nos. 6,976,604 and 7,185,784; *The First Years Inc. and Learning Curve Brands, Inc.* v. *Munchkin, Inc.*; Case No. 07-C-0558-C; Jun. 27, 2008.

Munchkin's Brief in Opposition to TFY's Motion for Partial Summary Judgment of Validity of U.S. Patent No. 6,976,604; *The First Years Inc. and Learning Curve Brands, Inc.* v. *Munchkin, Inc.*; Case No. 07-C-0558-C; Jun. 27, 2008.

TFY's Brief in Opposition to Munchkin's Motion for Partial Summary Judgment of Invalidity and Non-Infringement of the Claims of U.S. Patents No. 6,976,604 and 7,185,784; *The First Years Inc. and Learning Curve Brands, Inc.* v. *Munchkin, Inc.*; Case No. 07-C-0558-C; Jun. 27, 2008.

Munchkin's Reply to TFY's Brief in Opposition to Munchkin's Motion for Partial Summary Judgment of Invalidity and Non-Infringement of the Claims of U.S. Patents No. 6,976,604 and 7,185,784; *The First Years Inc. and Learning Curve Brands, Inc.* v. *Munchkin, Inc.*; Case No. 07-C-0558-C; Jul. 11, 2008.

Plaintiffs' Reply Brief in Support of Their Motion for Summary Judgment of Infringement of U.S. Patent Nos. 6,976,604 and 7,185,784; *The First Years Inc. and Learning Curve Brands, Inc.* v. *Munchkin, Inc.*; Case No. 07-C-0558-C; Jul. 11, 2008.

Defendant's Response to TFY's Supplemental Findings of Fact in Opposition to Munchkin's Motion for Summary Judgment; *The First Years Inc. and Learning Curve Brands, Inc.* v. *Munchkin, Inc.*; Case No. 07-C-0558-C; Jul. 11, 2008.

Plaintiffs' Reply Brief in Support of Their Motion for Partial Summary Judgment of Validity of U.S. Patent 6,976,604; *The First Years Inc. and Learning Curve Brands, Inc.* v. *Munchkin, Inc.*; Case No. 07-C-0558-C; Jul. 11, 2008.

Plaintiffs' Reply Brief in Support of Their Motion for Summary Judgment of No Inequitable Conduct; *The First Years Inc. and Learning Curve Brands, Inc.* v. *Munchkin, Inc.*; Case No. 07-C-0558-C; Jul. 11, 2008.

(56) References Cited

OTHER PUBLICATIONS

Plaintiffs' Surreply to Munchkin's Reply Brief in Support of Munchkin's Motion for Partial Summary Judgment; *The First Years Inc. and Learning Curve Brands, Inc.* v. *Munchkin, Inc.*; Case No. 07-C-0558-C; Jul. 18, 2008.
Plaintiffs' Motion for Leave to File and Supplemental Response in Opposition to Munchkin's Motion for Partial Summary Judgment; Plaintiff's Supplemental Findings of Fact in Opposition to Munchkin's Motion for Partial Summary Judgment; and Aug. 6, 2008 Declaration of Patricia L. Kusenberger in Support of Plaintiffs' Supplemental Response in Opposition to Munchkin's Motion for Partial Summary Judgment with Exhibits 1-2; *The First Years Inc. and Learning Curve Brands, Inc.* v. *Munchkin, Inc.*; Case No. 07-C-0558-C; Aug. 6, 2008.
Albert V. Karvelis, Ph.D. Transcript of Deposition taken Aug. 8, 2008; *The First Years Inc. and Learning Curve Brands, Inc.* v. *Munchkin, Inc.*; Case No. 07-C-0558-C; Aug. 20, 2008.
William J. Gartner Transcript of Videotaped Deposition taken Jul. 16, 2008; *The First Years Inc. and Learning Curve Brands, Inc.* v. *Munchkin, Inc.*; Case No. 07-C-0558-C; Aug. 21, 2008.
Tim A. Osswald, Ph.D. Transcript of Videotaped Deposition taken Aug. 11, 2008; *The First Years Inc. and Learning Curve Brands, Inc.* v. *Munchkin, Inc.*; Case No. 07-C-0558-C; Aug. 22, 2008.
Timothy Shedd, Ph.D. Transcript of Videotaped Deposition taken Aug. 20, 2008; *The First Years Inc. and Learning Curve Brands, Inc.* v. *Munchkin, Inc.*; Case No. 07-C-0558-C; Sep. 2, 2008.
Opinion and Order by the Court; *The First Years Inc. and Learning Curve Brands, Inc.* v. *Munchkin, Inc.*; Case No. 07-C-0558-C; Sep. 9, 2008.
Letter to Judge Crabb with Proposed Consent Judgment; *The First Years Inc. and Learning Curve Brands, Inc.* v. *Munchkin, Inc.*; Case No. 07-C-0558-C; Sep. 18, 2008. Court's Approval of the Consent Judgment; *The First Years Inc. and Learning Curve Brands, Inc.* v. *Munchkin, Inc.*; Case No. 07-C-0558-C; Sep. 22, 2008.
Learning Curve's Motion to Hold Munchkin in Contempt; *The First Years Inc. and Learning Curve Brands, Inc.* v. *Munchkin, Inc.*; Case No. 07-C-0558-C; Jun. 30, 2009.
Declaration of Tim A. Osswald, Ph.D., in Support of Learning Curve's Motion to Hold Munchkin in Contempt with Attachment 2; *The First Years Inc. and Learning Curve Brands, Inc.* v. *Munchkin, Inc.*; Case No. 07-C-0558-C; Jun. 30, 2009.
Munchkin's Brief in Response to Learning Curve's Motion to Hold Munchkin in Contempt; *The First Years Inc. and Learning Curve Brands, Inc.* v. *Munchkin, Inc.*; Case No. 07-C-0558-C; Aug. 19, 2009.
Learning Curve's Reply in Support of its Motion to Hold Munchkin in Contempt; *The First Years Inc. and Learning Curve Brands, Inc.* v. *Munchkin, Inc.*; Case No. 07-C-0558-C; Sep. 9, 2009.
Opinion and Order by the Court; *The First Years Inc. and Learning Curve Brands, Inc.* v. *Munchkin, Inc.*; Case No. 07- C-0558-C; Oct. 26, 2009.
Paul R. Bonenberger, "The First Snap-Fit Handbook," p. 4-7, 95-96, and 104-105, 2000.
Merriam Webster's Collegiate Dictionary, 10th Ed., p. 1093, 1995.
Complaint for Patent Infringement; *Learning Curve Brands, Inc.* v. *Munchkin, Inc.*; Case No. 09-C-0416-C; Jun. 30, 2009.
Defendant Munchkin, Inc.'s Answer, Affirmative Defenses, Counterclaims and Demand for Jury Trial; *Learning Curve Brands, Inc.* v. *Munchkin, Inc.*; Case No. 09-C-0416-C; Dec. 8, 2009.
Learning Curve Brands, Inc.'s Answer and Affirmative Defenses to Munchkin, Inc.'s Counterclaims; *Learning Curve Brands, Inc.* v. *Munchkin, Inc.*; Case No. 09-C-0416-C; Dec. 29, 2009.
Munchkin's Motion for Claims Construction; *Learning Curve Brands, Inc.* v. *Munchkin, Inc.*; Case No. 09-C-0416-C; Feb. 5, 2010.
Munchkin, Inc.'s Opening Claim Construction Brief; *Learning Curve Brands, Inc.* v. *Munchkin, Inc.*; Case No. 09-C-0416-C; Feb. 5, 2010.
Declaration of Timothy A. Shedd, Ph.D., in Support of Defendant's Opening Claim Construction Brief with Exhibits 1-8; *Learning Curve Brands, Inc.* v. *Munchkin, Inc.*; Case No. 09-C-0416-C; Feb. 5, 2010.
Learning Curve's Motion Requesting Claim Construction; *Learning Curve Brands, Inc.* v. *Munchkin, Inc.*; Case No. 09-C-0416-C; Feb. 5, 2010.
Learning Curve's Opening Claim Construction Brief; *Learning Curve Brands, Inc.* v. *Munchkin, Inc.*; Case No. 09-C-0416-C; Feb. 5, 2010.
Munchkin's Response to Learning Curve's Motion Requesting Claim Construction; *Learning Curve Brands, Inc.* v. *Munchkin, Inc.*; Case No. 09-C-0416-C; Feb. 19, 2010.
Learning Curve's Response to Munchkin's Opening Claim Construction Brief; *Learning Curve Brands, Inc.* v. *Munchkin, Inc.*; Case No. 09-C-0416-C; Feb. 19, 2010.
Declaration of Tim A. Osswald, Ph.D., In Support of Learning Curve's Response to Munchkin's Opening Claim Construction Brief with Attachment 4; *Learning Curve Brands, Inc.* v. *Munchkin, Inc.*; Case No. 09-C-0416-C; Feb. 19, 2010.
Opinion and Order by the Court; *Learning Curve Brands, Inc.* v. *Munchkin, Inc.*; Case No. 09-cv-416-bbc; Mar. 23, 2010.
Therma-Tuff Brochure; Lawson Mardon Packaging; Lawson mardon Thermaplate Corporation (11 pages); brochure available prior to Oct. 5, 2001.
Eileen M. King, "Gladware Introduces Versatile-Disposable Food Containers Items May be the Forerunners of a New Category in Food Storage," HFN The Weekly Newspaper for the Home Furnishing Network, Sep. 7, 1998.
Gladware advertisement (1 page); available prior to Oct. 5, 2001.
Ziploc Brand Containers; available at: http://www.scjbrands.com/docs/ziploc/products/crcs/containers.html; available prior to Oct. 5, 2001.
The First Years 1995 catalog showing Tumble Mates cups; (6 pages) available prior to Oct. 5, 2001.
Picture of a sample of a Tumble Mates cup submitted to the U.S. District Court for the Western District of Wisconsin (*The First Years Inc., and Learning Curve Brands, Inc.* v. *Munchkin, Inc.* under Civil Action No. 07-C-0558-C); sample available prior to Oct. 5, 2001.
1994 Tupperware Catalog for SipperSeal product;.
1997 Tupperware Catalog for SipperSeal product.
Declaration of John Doninger.
Opinion and Order of the Court; *Learning Curve Brands, Inc.* v. *Munchkin, Inc.*; Case No. 09-cv-416-bbc; Sep. 29, 2010.
Opinion and Order by the Court on Infringement; *Learning Curve Brands, Inc.* v. *Munchkin, Inc.*; Case No. 09-cv-416-bbc; Apr. 12, 2011.
Opening Brief of Plaintiff-Appellant Learning Curve Brands, Inc.; *Learning Curve Brands, Inc.* v. *Munchkin, Inc.*, U.S. Court of Appeals for the Federal Circuit; Case No. 2011-1036; Sep. 29, 2011.
Brief of Defendant-Appellee Munchkin, Inc.; *Learning Curve Brands, Inc.* v. *Munchkin, Inc.*, U.S. Court of Appeals for the Federal Circuit; Case No. 2011-1036; Nov. 14, 2011.
Reply Brief of Plaintiff-Appellant Learning Curve Brands, Inc.; *Learning Curve Brands, Inc.* v. *Munchkin, Inc.*, U.S. Court of Appeals for the Federal Circuit; Case No. 2011-1036; Dec. 9, 2011.
Decision by the U.S. Court of Appeals for the Federal Circuit; *Learning Curve Brands, Inc.* v. *Munchkin, Inc.*, U.S Court of Appeals for the Federal Circuit; Case No. 2011-1036; Mar. 30, 2012.
Recording of the oral argument in *Learning Curve Brands, Inc.* v. *Munchkin, Inc.*, U.S. Court of Appeals for the Federal Circuit; Case No. 2011-1036; available at http://www.cafc.uscourts.gov/oral-argument-recordings/search/audio.html (search under Appeal No. 2011-1036).
Canadian Office action for Application No. 2,777,735 dated Apr. 2, 2013.
International Search Report for International Application No. PCT/US/31875 dated Feb. 24, 2003.
International Preliminary Examination Report for International Application No. PCT/US02/31875 dated Aug. 21, 2003.

* cited by examiner

DRINKING CONTAINERS

RELATED APPLICATIONS

This application is a divisional application of and claims priority to U.S. patent application Ser. No. 10/819,245, filed on Apr. 5, 2004, which is a continuation application of and claims priority to PCT application number PCT/US02/31875, filed on Oct. 4, 2002, and designating the United States, and is a continuation-in-part application of and claims priority to U.S. application Ser. No. 09/971,499, filed on Oct. 5, 2001, now U.S. Pat. No. 6,976,604. The entire contents of all of the priority applications are incorporated herein by reference, as if entirely set forth.

TECHNICAL FIELD

This invention relates to drinking containers, and more particularly to spill-resistant drinking containers for children, such as those commonly known as "sippy cups."

BACKGROUND

Children's drinking cups are generally provided with removable lids, to help prevent large spills. Commonly, these lids have drinking spouts extending from their upper surface, that children place in their mouths to sip from the cups. Such cups are sometimes called "sippy cups." Some sippy cup spouts have open slots or holes through which the liquid in the cup flows when the cup is inverted. Such slots or holes are generally sized for an acceptably high flow rate, for ease of cleaning, and to enable the passage of small drink particulates such as pulp in orange juice. Many parents understandably prefer sippy cups with valves that close off any flow opening in the spout until suction is supplied by the child, instead of permanently open holes or slots. The design of such valves traditionally entails a trade-off between flow rate during drinking and leak rate when not in use. Also, many such valves can be difficult to properly clean. Some valves are removable and can be misplaced. Some sippy cup valves are in the form of a flexible membrane with a normally closed slit which opens sufficiently under pressure to enable acceptable flow.

SUMMARY

We have realized that a drinking spout, such as that of a sippy cup lid, can provide an acceptably high flow rate and an acceptably low leak rate when equipped with a plurality of normally open holes of a particularly small size.

Several aspects of the invention feature a drinking container that includes a main body defining an interior cavity accessible through an opening at an upper end of the main body, and a removable lid secured to the main body at its upper end to cover the opening and enclose, together with the main body, the interior cavity to hold a liquid.

According to one aspect of the invention, the lid has an extended drinking spout defining multiple unrestricted holes providing open hydraulic communication between exterior surfaces of the container and the interior cavity. The holes have a size selected to permit less than 3 drops of leakage of fresh water from the interior cavity through the holes over a 10 second interval under quasi-static conditions with the container inverted, a static head of 2.0 inches (51 millimeters) of fresh water at the inner ends of the holes, and no vacuum applied to the spout; and to dispense an aggregate of at least 1.3 gram of fresh water from the spout over a 10 second interval with a static vacuum of 0.27 Bar below atmospheric pressure applied at the outer ends of the holes and a static head of 2.0 inches (51 millimeters) of fresh water at the inner ends of the holes, with the container inverted.

In some embodiments, the holes are defined through a membrane having a nominal thickness of between about 0.010 and 0.040 inch (0.25 and 1.0 millimeter), preferably between about 0.015 and 0.030 inch (0.4 and 0.8 millimeter), at the holes.

Preferably, the membrane comprises a semi-rigid material, and more preferably consists of a semi-rigid material. By "semi-rigid," we mean a material that is not rubber-like or elastomeric, that is not elastic or resilient in use, as opposed, for example, to materials typically employed to form baby bottle nipples and the like. Molded polypropylene is a presently preferred semi-rigid material.

The membrane is preferably dimensionally stable, and in some cases is generally planar and perpendicular to a longitudinal axis of each hole.

In some preferred embodiments, the membrane is recessed within the drinking spout, such as a distance of at least 0.25 inch (6.4 millimeters). In some configurations, the membrane, is advantageously integrally and unitarily molded from a resin, preferably with a nominal molded thickness of less than about 0.035 inch (0.90 millimeter), more preferably with a nominal molded thickness of between about 0.020 and 0.026 inch (0.51 and 0.66 millimeter).

In some cases the lid forms an air-tight seal around its rim with the main body, at the upper end of the main body. In some other cases, only a liquid-tight seal is provided, allowing some air venting between the lid and body.

In some embodiments, the lid has a main body portion defining a peripheral groove sized to receive an upper rim of the cup. The lid may also have a snap ridge extending into the groove, or below the groove, at an outer edge thereof and positioned to snap under a rim of the cup when the cup and lid are fully engaged. In some cases, the snap ridge is discontinuous about a periphery of the lid.

Preferably, the holes each have a major lateral extent, perpendicular to a flow path along the hole, of less than about 0.025 inch (0.64 millimeter). More preferably, the major lateral extent of the holes is less than about 0.020 inch (0.51 millimeter), and even more preferably less than about 0.014 inch (0.36 millimeter). By "major lateral extent," we mean a greatest dimension measured transverse to flow, at a hole cross-section of minimum flow area. For a straight, cylindrical hole, for example, this would be the diameter of the hole.

Some spouts define at least four such holes, with each hole having a diameter of less than about 0.012 inch (0.30 millimeter), and some spouts define at least eight such holes.

In some particularly preferred embodiments, the holes are defined by molded surfaces of the drinking spout.

Some embodiments have holes that are flared at their inner ends. Some holes are defined through a membrane having a nominal thickness and forming a protruding lip about each hole, such that the holes each have a length greater than the nominal thickness of the membrane. In some cases such a lip extends toward the interior cavity. In some other cases, the lip extends away from the interior cavity. The lip tapers to a distal edge in some instances.

In some preferred embodiments, and particularly advantageous for disposability, both the main body and the lid are each formed of molded resin of a nominal wall thickness of less than about 0.035 inch (0.89 millimeter), preferably less than about 0.025 inch (0.64 millimeter). With this low nominal wall thickness, the bottom of the main body may have a slightly increased wall thickness, such as up to about 0.040 inch (1.0 millimeter) for increased impact resistance. For improved disposability, some versions of the drinking containers preferably have an empty weight less than about 30 grams, more preferably less than about 20 grams.

Some lids are formed of a resin containing polypropylene.

To enhance the development of surface tension at the holes, lid material defining the holes preferably has a natural state surface energy of less than about 35 dynes per centimeter.

According to another aspect of the invention, a drinking container has a main body defining an interior cavity accessible through an opening at an upper end of the main body, and a removable lid secured to the main body at its upper end to cover the opening and enclose, together with the main body, the interior cavity to hold a liquid. The lid has an extended drinking spout sized to be received within a human mouth and defining multiple unrestricted holes providing open hydraulic communication between exterior surfaces of the container and the interior cavity, for dispensing liquid disposed proximate inner ends of the holes in response to a vacuum applied at outer ends of the holes. The holes each have a major lateral extent, perpendicular to a flow path along the hole, of less than about 0.025 inch (0.64 millimeter), and together form an aggregate flow path through the spout of an area of at least 0.35 square millimeter.

The holes are preferably of a size selected to cause fresh water in the interior cavity to form a stable meniscus at the holes under a static pressure head of 2.0 inches (51 millimeters) of fresh water, with the container inverted and atmospheric pressure applied to the outer ends of the holes.

Preferably, the holes form an aggregate flow path through the spout of an area of at least 0.42 square millimeter, even more preferably an area of at least 0.50 square millimeter.

In some preferred embodiments, the holes are defined through a dimensionally stable, semi-rigid membrane having a nominal thickness of between about 0.010 and 0.040 inch (0.25 and 1.0 millimeter) at the holes. In some cases, the membrane is generally planar and perpendicular to a longitudinal axis of each hole, and recessed within the drinking spout.

The lid, including the membrane, is in some instances integrally and unitarily molded from a resin, such as polypropylene. Preferably, the lid has a nominal molded thickness of less than about 0.035 inch (0.90 millimeter).

In some embodiments, the lid forms an air-tight seal with the main body at the upper end of the main body.

Preferably, the major lateral extent of the holes is less than about 0.020 inch (0.51 millimeter), and more preferably less than about 0.014 inch (0.36 millimeter).

Some drinking spouts define at least four such holes, and some at least eight such holes.

The holes are preferably defined by molded surfaces of the drinking spout, such as surfaces formed as the lid is molded.

Various holes are configured as described above with respect to embodiments of the first aspect of the invention.

In some cases, both the main body and the lid are each formed of molded resin of a nominal thickness of less than about 0.035 inch (0.89 millimeter), and the two together have an empty weight less than about 30 grams, preferably less than about 20 grams.

Preferably, the lid material defining the holes has a natural state surface energy of less than about 35 dynes per centimeter.

In some embodiments, the spout forms an inwardly-extending dam wall about the holes. The spout may also have a distal rim defining an interior trough for receiving fluid as the container is inverted.

Some examples include a baffle plate disposed between the interior cavity and the lid, for inhibiting high flow rates into the spout.

In some instances, the lid has a resiliently deformable region adapted to be displaced outward under pressure from container contents when the container is inverted to increase container volume, thereby reducing pressure within the interior cavity. The deformable region may extend about the spout, and/or may comprise flexible undulations that may be molded. In some cases the resiliently deformable region is of an elastomeric material molded over an aperture of the lid.

In some illustrated examples, the main body defines indentations in side surfaces thereof, for enhanced graspability. According to yet another aspect of the invention, a lid is provided for a drinking container for children. The lid has a main body portion defining a peripheral groove sized to receive an upper rim of a cup to enclose a cavity for holding a liquid, and a drinking spout extending from the main body portion toward an outer side of the body portion. The spout defines multiple unrestricted holes providing open hydraulic communication between opposite sides of the lid, for dispensing liquid disposed proximate inner ends of the holes in response to a vacuum applied at outer ends of the holes. The holes each have a major lateral extent, perpendicular to a flow path along the hole, of less than about 0.025 inch (0.64 millimeter), and together form an aggregate flow path through the spout of an area of at least 0.35 square millimeter.

Preferably, the holes are of a size selected to cause fresh water at the inner ends of the holes to form a stable meniscus at the holes under a static pressure head of 2.0 inches (51 millimeters) of fresh water, with the lid inverted such that the spout extends downward and atmospheric pressure applied to the outer ends of the holes.

In some preferred embodiments, the holes are defined through a membrane having a nominal thickness of between about 0.010 and 0.040 inch (0.25 and 1.0 millimeter) at the holes.

As discussed above, the membrane preferably comprises a semi-rigid material.

In some cases, the holes are defined through a dimensionally stable membrane within the drinking spout, with the membrane preferably recessed at least 0.25 inch (6.5 millimeters) within the drinking spout, as measured from a distal end of the spout. In some instances, the membrane is generally planar and perpendicular to a longitudinal axis of each hole, and the lid, including the membrane, is integrally and unitarily molded from a resin such as polypropylene.

In some embodiments, the lid has a nominal molded thickness of less than about 0.035 inch (0.90 millimeter), preferably between about 0.020 and 0.026 inch (0.51 and 0.66 millimeter).

Some preferred lids have a solid surface across their extent, save for the drinking holes.

Preferably, the holes each have a major lateral extent, perpendicular to a flow path along the hole, of less than about 0.020 inch (0.51 millimeter), and more preferably less than about 0.014 inch (0.36 millimeter).

In some cases the drinking spout defines exactly three such holes, with each hole having a minimum diameter of between about 0.010 and 0.025 inch (0.25 and 0.64 millimeter), in some cases about 0.015 inch (0.38 millimeter). In some other cases, the drinking spout defines at least four such holes, with each hole having a diameter of less than about 0.020 inch (0.51 millimeter). In some configurations the drinking spout defines at least eight such holes.

Preferably, the holes are defined by molded surfaces of the drinking spout, and various holes are configured as described above with respect to embodiments of the first aspect of the invention.

In some embodiments the holes are of frusto-conical shape, with a larger end of each hole directed toward an inner side of the lid. The lid, in some constructions, is formed of a resin containing polypropylene.

Preferably, the lid material defining the holes has a natural state surface energy of less than about 35 dynes per centimeter.

One aspect of the invention features a drinking container with an improved sealing connection between lid and body. The container includes a main body defining an interior cavity accessible through an opening at an upper end of the main body, the body having a rim about its opening, the rim having a domed upper surface. A removable lid is secured to the main body at its upper end to cover the opening and enclose, together with the main body, the interior cavity to hold a liquid. The lid defines a groove about its edge sized to receive and snap over the rim of the main body and form a seal. The lid also has an extended drinking spout sized to be received within a human mouth and defining at least one unrestricted hole providing open hydraulic communication between exterior surfaces of the container and the interior cavity, for dispensing liquid disposed proximate an inner end of the hole in response to a vacuum applied at an outer end of the hole.

Particularly, the groove about the lid has an inner surface, and the rim of the main body has an outer surface, that each define semi-circular arcs of similar radii and have interlocking features on an inboard side. The interlocking features include a first lip projecting radially outward from the lid into the groove and a second lip projecting radially inward from the outer surface of the rim of the main body to produce a nominal radial interference between the first and second lips as the lid and main body are engaged. In a particularly preferred embodiment, the first lip protrudes about 0.008 inch (0.2 millimeter) laterally into the groove from a vertical tangent to an inner edge of an upper, inner surface of the groove and the second lip protrudes about 0.008 inch (0.2 millimeter) toward a centerline of the main body from a vertical tangent to an inner edge of the outer surface of the rim.

The nominal radial interference between the first and second lips is preferably about 0.016 inch (0.4 millimeter).

In some cases, the lid also has at least one snap ridge extending downwardly and inwardly from an outer edge of the groove and positioned to snap below a lower, distal edge of the cup rim when the cup and lid are fully engaged.

In some configurations the lid includes a bending tab (26) extending radially outward near one of the snap ridges.

According to another aspect of the invention, a method of forming a lid for a drinking container is provided. The method includes injecting moldable resin into a closed die cavity defining a body cavity portion shaped to mold a body portion with a peripheral groove sized to receive an upper rim of a drinking container and, contiguous with the body cavity portion, a spout cavity portion shaped to mold a drinking spout sized to be received within a human mouth, with pins extending across the body cavity portion, the pins each having a diameter of less than about 0.025 inch (0.64 millimeter). The injected resin is solidified to form a lid shaped by the die cavity, the lid having a drinking spout with molded surfaces defining holes corresponding to the pins. The die cavity is opened, and the lid is removed from the cavity.

In some instances, the resin comprises polypropylene.

Preferably, the resin has a natural state surface energy of less than about 35 dynes per centimeter.

In some preferred embodiments, each pin has a diameter of less than about 0.020 inch (0.51 millimeter), for molding particularly small drinking holes.

In some cases, the die cavity has a series of at least three pins extending therethrough, for forming a corresponding number of holes in the lid.

In some embodiments, the die cavity is unobstructed across its extent in all directions, save for the pins.

According to yet another aspect, a method of preventing spills from drinking containers for children is provided. The method includes filling a cup with a consumable liquid, and securing a lid as described above across an upper end of the cup.

Without intending to be limiting, we theorize that such small holes each sufficiently resist leakage because they are small enough to enable a meniscus of fluid to develop across the holes that holds back the static weight of the liquid in the cup due to surface tension in the meniscus until suction is applied to the spout. Once suction is applied by a drinking child, the surface tension is overcome and the liquid flows more readily through the hole.

The number of holes is chosen to provide sufficient total flow rate for drinking.

Such small drinking holes may limit the utility of such sippy cup lids with respect to particularly viscous drinks or juices with significant pulp content. However, these small holes can be particularly inexpensive to produce, and can even be formed during lid molding without secondary operations. Provided through a particularly thin, semi-rigid wall of the spout, for example, these small holes can be readily cleaned by automatic dishwashing methods. Alternatively, lids with such holes can be produced with such economy as to make the lid practically disposable, as a single use item, eliminating the need for cleanability.

The details of one or more embodiments of the invention are set forth in the accompanying drawings and the description below. Other features, objects, and advantages of the invention will be apparent from the description and drawings, and from the claims.

Other aspects of the invention will become apparent by consideration of the detailed description and accompanying drawings.

BRIEF DESCRIPTION OF THE DRAWINGS

Like reference symbols in the various drawings indicate like elements.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
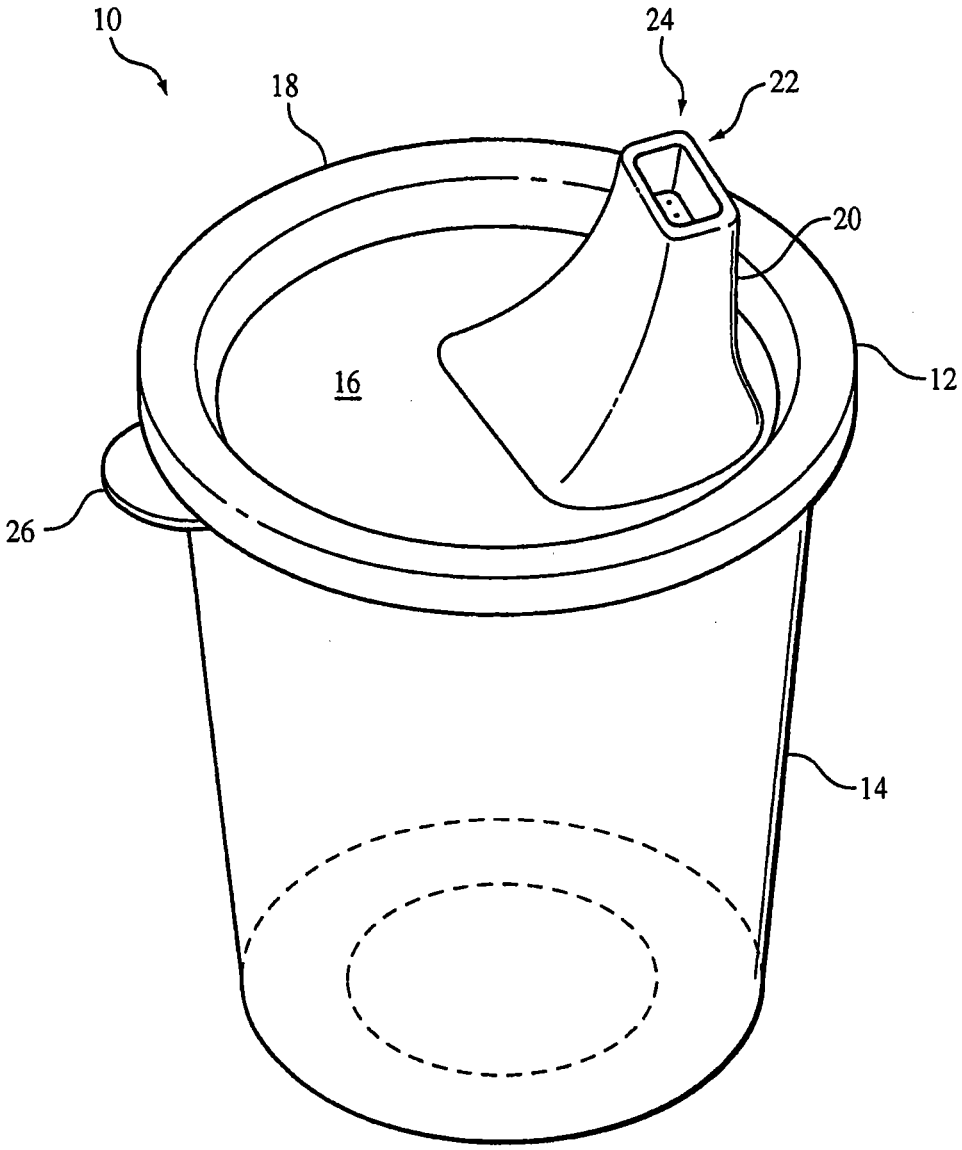
FIG. 1 is a perspective view of a disposable sippy cup.

Referring first to FIG. 1, cup 10 consists essentially of a lid 12 and a cup body 14, each molded of a polypropylene to have a nominal wall thickness of between about 0.020 and 0.026 inch (about 0.5 millimeter). Lid 12 has a generally planar upper surface 16 about the perimeter of which a circular ridge 18 extends upward to form a groove on the underside of the lid to receive an upper rim of the cup body 14. A drinking spout 20, integrally molded with the rest of the lid, extends upward from surface 16 to a distal end 22 shaped and sized to be comfortably received in a child's mouth for drinking. The upper end of the spout defines a blind recess 24 with a lower surface defining a series of drinking holes discussed in more detail below. Besides the drinking holes in the spout recess, the rest of lid 12 forms an air-tight seal at the top of cup body 14. A tab 26 extends laterally from an edge of the lid opposite spout 20, for prying the lid off of the cup body.

Figure 2:
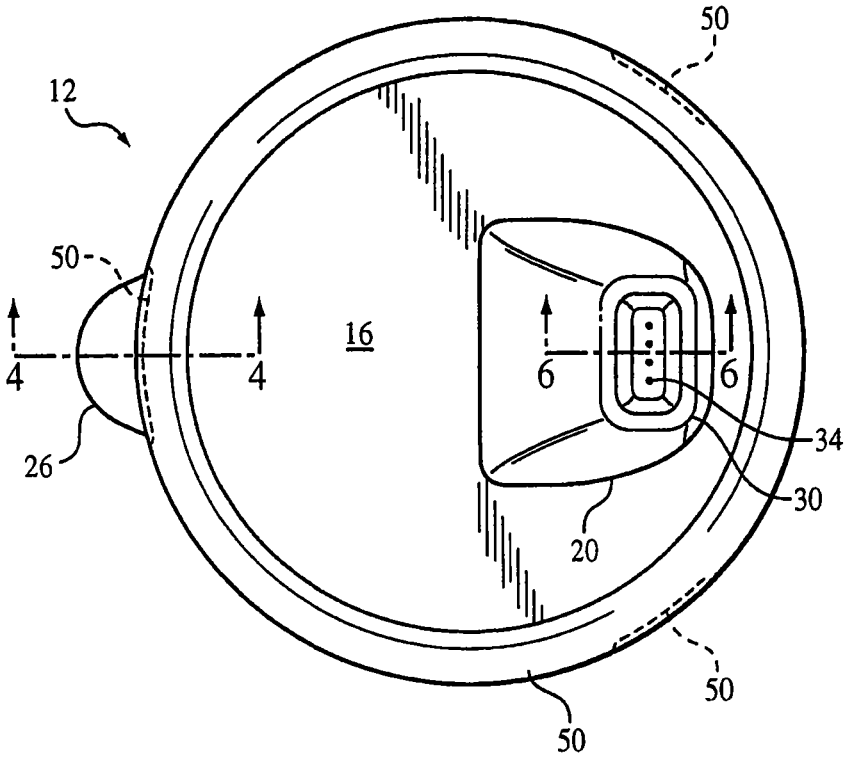
FIG. 2 is a top view of the lid of the sippy cup.
Figure 3:
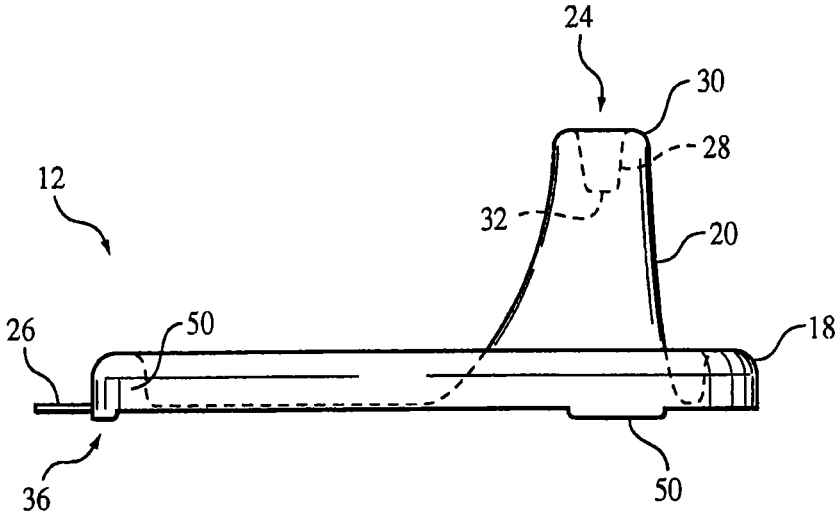
FIG. 3 is a side view of the cup lid.

FIGS. 2 and 3 further illustrate features of lid 12, such that the vertical walls 28 bounding recess 24 taper slightly toward each other from an upper rim 30 to a lower recess floor 32. A series of open, fixed holes 34 are molded through floor 32 to form a means of hydraulic communication through the spout. In this illustrated embodiment, four holes 34 are shown. Other embodiments have two, three, or more than four holes 34, as shown in later figures. FIG. 3 shows the circular perimeter groove 36 formed within ridge 18 on the underside of the lid.

Figure 4:
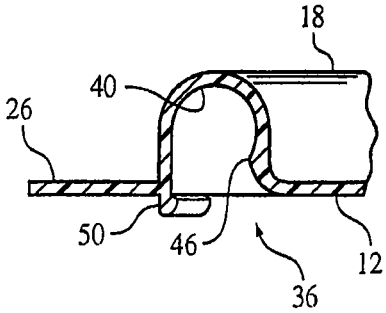
FIG. 4 is a cross-sectional view, taken along line 4-4 in FIG. 2.
Figure 5:
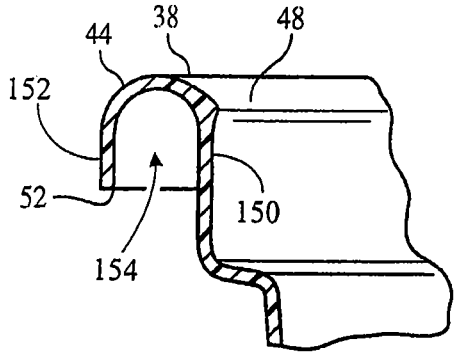
FIG. 5 is a radial cross-sectional view taken through the cup rim.

As shown in the enlarged views of FIGS. 4 and 5, the inner contour of groove 36 and outer contour of cup body rim 38 are selected to provide a slight snap fit of the lid onto the cup body, to provide a secure seal. The upper, inner surface 40 of ridge 18 of the lid and the upper, outer surface 44 of rim 38 of the cup body define semi-circular arcs of similar radii. These surfaces blend into tangential, vertical walls on the outboard side of the ridge and rim, but interlocking features are provided on the inboard side for an interference fit. On the lid (FIG. 4) this includes an outwardly projecting lip 46 that protrudes about 0.008 inch (0.2 millimeter) laterally into groove 36 from a vertical tangent to the inner edge of the upper, inner surface 40 of the groove. Similarly, on the cup body (FIG. 5), an inwardly projecting lip 48 protrudes about 0.008 inch (0.2 millimeter) toward the centerline of the cup body from a vertical tangent to the inner edge of the upper, outer surface 44 of the ridge. Thus, lips 46 and 48 produce a nominal maximum radial interference between rim 38 and groove 36 of about 0.016 inch (0.4 millimeter) as the two pieces are engaged. Rim 38 has an inner wall 150 and an outer wall 152 defining a recess 154 between them.

To further help to maintain the engagement of cup body and lid, in this particular embodiment groove 36 has three snap ridges 50 extending downwardly and inwardly at the outer edge of the groove and positioned to snap below the lower, distal edge 52 of cup rim 38 when the cup and lid are fully engaged. A portion of one snap ridge 50 is visible in FIG. 4. The other snap ridges 50 are located at about 120 degree spacing about the lid perimeter, as shown in FIG. 2. Bending tab 26 upward helps to disengage the adjacent snap ridge 50 to remove the lid from the cup body.

The above-described snap connection between lid and body is readily producible by low-cost molding techniques and is therefore preferred for disposable versions of the drinking container. However, other methods of securing the lid to the body are envisioned. For example, a threaded connection may be provided about the cup rim. A third member (not shown) may alternatively be employed to secure the lid and body in sealed relation, either as a clip or a cup holder. Such a third member may be fashioned to be retained and used with several disposable cups, and may carry decorative graphics.

Figure 6:
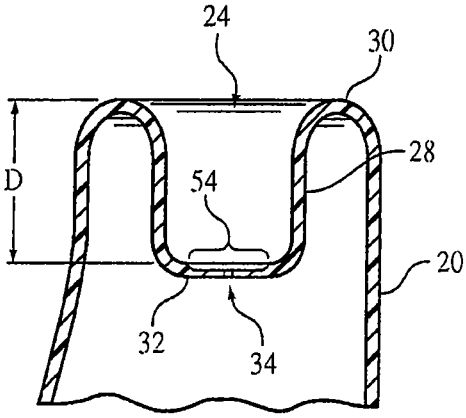
FIG. 6 is a cross-sectional view of the spout, taken along line 6-6 in FIG. 2.

Referring now to FIG. 6, recess floor 32 has a membrane portion 54 of a slightly lower thickness than the rest of spout 20. It is through this membrane portion 54 that holes 34 extend. In this illustrated embodiment, semi-rigid spout wall 54 has a tightly controlled thickness of 0.029 inch. The structure of the upper portion of spout 20 is such that membrane 54 maintains its generally planer, as-molded form during normal use, even with significant pressure applied to the outer surfaces of the spout. Furthermore, placing membrane 54 at the bottom of recess 24, a distance "D" of at least 0.25 inch (6.5 millimeters), protects holes 34 from damage or any unintentionally sharp edges about the holes from contacting a child's lips.

Various configurations of holes 34, as illustrated by example in FIGS. 7 through 11, provide different advantages for different applications.

Figure 7:
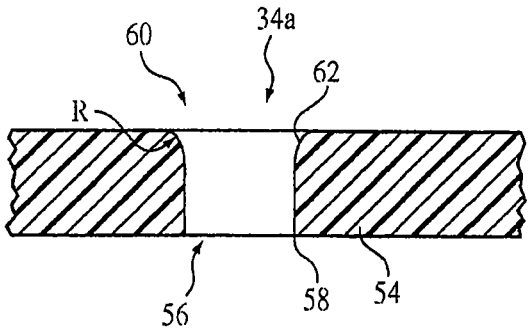
FIG. 7 is a cross-sectional view of a drinking hole in the spout.

FIG. 7, for example, shows a hole 34*a* that has an inner end 56, facing the cup side of the lid, with a sharp, square edge 58 about its circumference. On the other hand, its outer end 60, facing the spout recess, has a peripheral boundary 62 defined by a radius "R." Such a rounded exit edge may be formed, for example, by providing a radius about the base of a hole-molding pin pressed into a mold half forming the outer side of the membrane 54. Rounded edge 62 is thus likely to be free of any undesirable flash edges that could be reached by the tip of a child's tongue.

Figure 8:
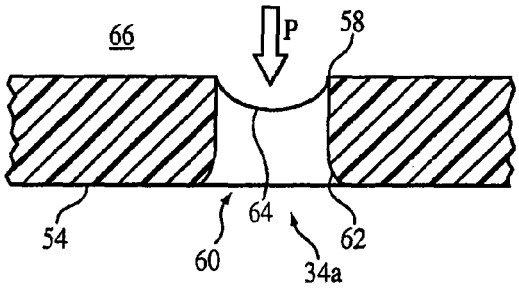
FIG. 8 illustrates flow through the hole being resisted by surface tension.

FIG. 8 illustrates the formation of a stable fluid bulge 64 extending into hole 34*a* from its inner end, under static pressure "P" applied by the weight of the liquid in the cup when the cup is inverted. A fluid membrane at the free surface of the bulge carries a surface tension that resists the rupture of the fluid membrane and the undesired leakage of the fluid through the hole. The level of pressure "P" that can be resisted by such surface tension will be a function of the relative surface energies of both the fluid 66 and the lid material at the interface between the edge of the bulge 64 and membrane 54 (at 58, for instance). Resistance to leakage will also depend on fluid viscosity and lateral hole dimensions. We have found that, for many liquids commonly consumed by small children, such as fruit juices, water and whole milk, circular holes 34*a* of a diameter less than about 0.025 inch (0.64 millimeter) acceptably resist leakage under a quasi-static head of about two inches of these liquids with no suction applied to the spout. Preferably, the lid should not leak more than 3 drops of liquid over a 10 second interval, with two vertical inches of liquid over the holes and no suction applied, after being gently rotated to an inverted position at a rate of about 180 degrees per second.

Figure 9:
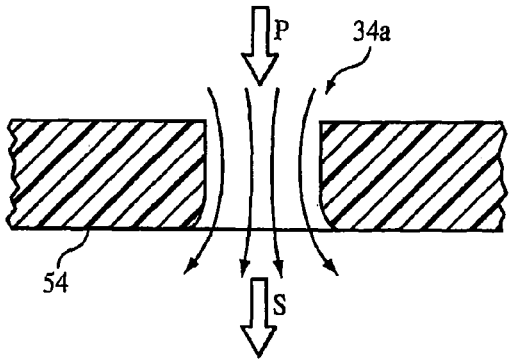
FIG. 9 illustrates flow enabled by the application of suction to the spout.

On the other hand, when a sub-atmospheric pressure "S" is applied to the outer end of the same hole as shown in FIG. 9, with the lid inverted, the maximum surface tension capacity of the bulge free surface will be exceeded and flow will commence. Once flow begins, it is likely to continue even if suction is removed. Because of this tendency, and because this lid contains no deformable or movable sealing surface to stop the flow when suction is removed, we recommend sizing holes 34*a* small enough that such flow will rarely be initiated without applied suction. Of course, conditions will arise that can cause undesirable flow initiation in the absence of suction, such as a child purposefully hammering on a hard surface with the spout of an inverted cup, but for many commercial applications the economic advantage of our approach can outweigh such concerns.

Figure 12A:
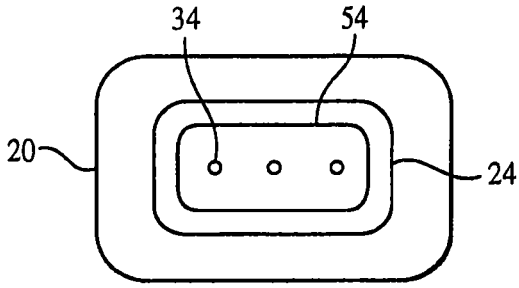
FIGS. 12A through 12E show various hole arrangements.
Figure 12B:
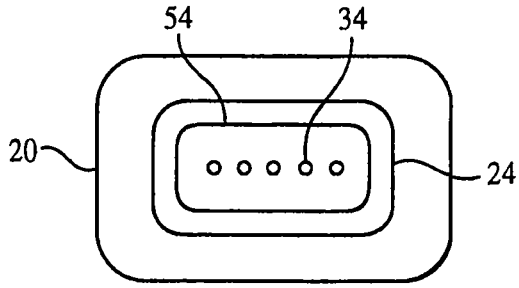
Figure 12C:
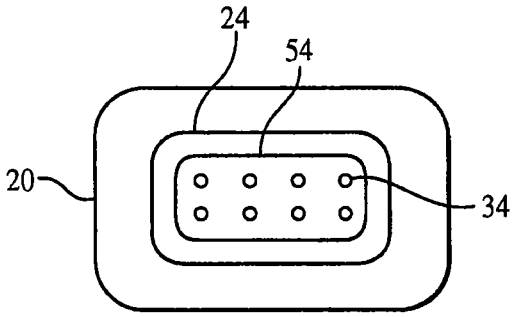
Figure 12D:
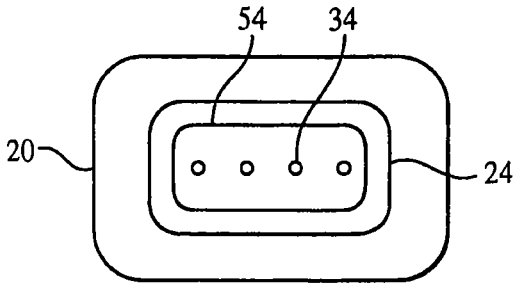
Figure 12E:
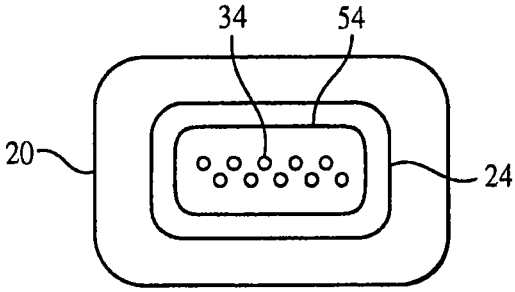

Given that each drinking hole of the spout is small enough to avoid leakage under normal non-suction conditions, an acceptable flow rate under drinking conditions is obtained by providing a sufficient number of holes. Preferably the holes will form an aggregate flow area, perpendicular of flow, sufficient to obtain a flow rate of at least 1.3 grams of liquid over a 10 second interval, with the cup inverted, about two vertical inches of liquid over the holes, and a steady vacuum equivalent to 8 inches of mercury (0.27 Bar) applied to the spout after inversion. Preferably, the aggregate flow area will be at least 0.35 square millimeter. In one present arrangement shown in FIG. 12A, the spout has a total of three separate holes, each with a diameter of about 0.017 inch, forming an aggregate flow area of about 0.44 square millimeter. In some other arrangements, shown in FIGS. 12B through 12E, other numbers of holes 34 are arranged in various patterns. FIGS. 12B and 12D, for example, show five and four holes 34, respectively, spaced apart along a line. FIGS. 12C and 12E, on the other hand, show eight and ten holes 34, respectively, arranged in two lines, with the holes 34 of FIG. 12E in a staggered arrangement. The larger the number of holes, the smaller each individual hole may be formed, to a practical limit, to decrease the propensity of leakage while maintaining an acceptable suction flow rate.

Referring back to FIG. 1, cup 10 is completely sealed with the exception of the drinking holes in spout 20. In other words, no vent allows air to flow into the cup as the liquid is dispensed. An air tight seal is maintained between the groove of lid 12 and the rim of cup body 14, such that a slightly sub-atmospheric pressure will develop within the cup body during drinking. As soon as drinking stops and the cup is uprighted, however, air will enter the cup through the drinking holes to eliminate any pressure difference. We find this to be acceptable for many applications, as children beyond nursing age do not typically maintain suction indefinitely while drinking. Furthermore, with disposable cup body 14 formed to have a particularly thin wall thickness, any substantial vacuum within the cup body will only tend to temporarily buckle the cup body wall if a child continues to build interior cup vacuum. In some other embodiments, the cup rim and lid groove are configured to allow some venting to occur.

Cup 10 is molded of high clarity, polypropylene random copolymer resin, such as PRO-FAX SW-555M or MOPLEN RP348N, both available from Basell in Wilmington, Del. or Basell N.V. in The Netherlands (www.basell.com). The resin preferably includes an impact strength-enhancing modifier or additive, and has a particularly low weight and thickness that make the cup suitable for one-time use. For example, the seven-ounce (200 milliliter) cup body 14 shown in FIG. 1 has a nominal wall thickness of only about 0.025 inch (0.64 millimeter) with a thicker base of about 0.039 inch (1.0 millimeter) and weighs, together with the lid, only about 18.2 grams. A similar ten-ounce (300 milliliter) version weighs about 25.7 grams with the lid. The material should meet FDA and other government standards for food-contact use. This particular material is also microwavable.

Furthermore, the design of the cup and lid make them individually nestable with other such cups and lids, such as for storing or retail packaging of multiple cups with multiple lids. Lid 14, however, may also be packaged and sold separately as a disposable lid for a non-disposable cup.

Figure 13:
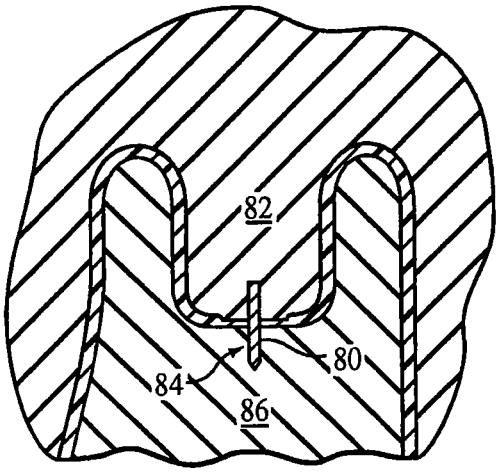
FIG. 13 is a cross-section through a mold for molding the upper end of the drinking spout and the holes.

The presently preferred method of forming the drinking holes in lid spout 20 is to form the holes as the spout itself is molded, rather than performing a post-molding operation to form the holes. Alternatively, the drinking holes may be formed by piercing or laser cutting, although these processing steps tend to add cost and can, in some cases, produce more variability in hole properties than molding. Referring to FIG. 13, we have found that these holes can be formed by a fixed pin 80 rigidly pressed into one of two opposing mold halves (e.g., into upper mold half 82) and either extending either into a corresponding hole 84 in the opposite mold half 86, as shown, or of a length selected to cause the distal end of the pin 80 to butt tightly up against the opposing mold surface to avoid molding flash that could seal off the intended hole.

Figure 10:
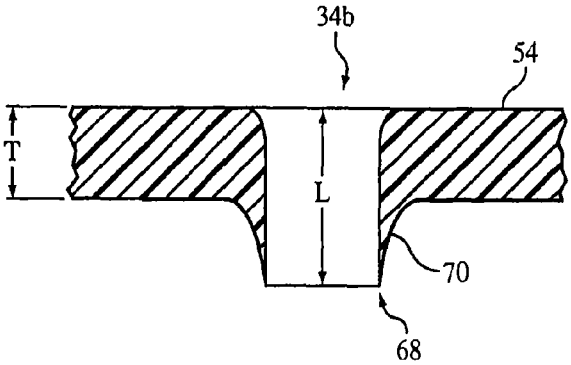
FIG. 10 shows a drinking hole with a raised lip.

Many individual hole configurations are envisioned. Because the properties of the hole-defining surface where the edge of the stable liquid free surface forms (e.g., at the inner hole perimeter) are considered particularly important, we recommend maintaining close tolerances and strict quality controls, frequently replacing or repairing wearing mold surfaces that form these areas. For some applications, a curved inner hole edge will be preferred, such as by inverting the configuration of FIG. 7. In some cases a very sharp entrance edge 68 will be desired, such as may be produced at the distal end of a conical extension 70 surrounding a hole 34*b* on the inner surface of membrane 54, as shown in FIG. 10. Such a conical extension 70 is also useful for producing a longer axial hole length "L" than the nominal membrane thickness "T." If such an elongated hole is desired without a sharp entrance edge, the extension may be disposed on the other side of membrane 54. Extension 70 may be formed, for example, in a generous lead-in chamfer about a hole in a side of the mold forming the inner surface of membrane 54, that accepts a hole-forming pin rigidly secured to and extending from an opposite mold half.

Figure 11:
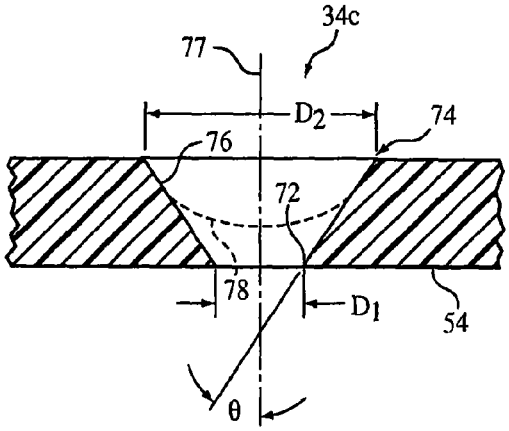
FIG. 11 shows a tapered hole.

As shown in FIG. 11, frustoconical holes 34*c* may also be employed. In the embodiment shown, at its outer edge 72 hole 34*c* has a diameter $D_1$ of about 0.017 inch (0.43 millimeter), while at its inner end 74 it has a diameter $D_2$ of about 0.061 inch (1.5 millimeter). With a nominal membrane thickness of about 0.029 inch (0.74 millimeter), hole side wall 76 is sloped at an angle .theta., with respect to the hole axis 77, of about 37 degrees. It is believed that the inward slope of hole wall 76 aids in the development and support of a stable fluid meniscus 78, as shown in dashed outline. Tapered hole 34*c* may be formed by an appropriately tapered mold pin that either extends a distance into a corresponding recess in the opposite molding surface, or, with proper quality controls and tight tolerances, butt up against a flat opposite mold surface without any receiving recess, without significant flash concerns.

Figure 14:
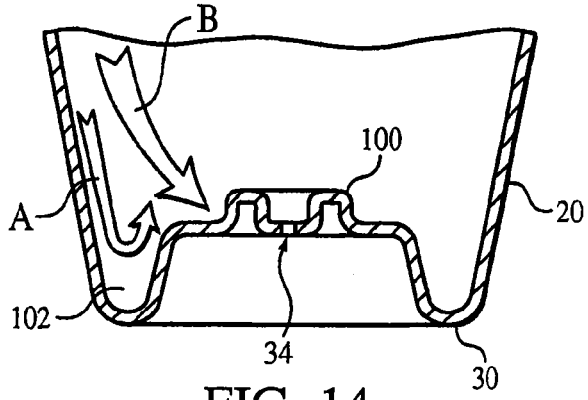
FIG. 14 is a cross-sectional view through a spout of another embodiment, shown inverted.

Other features may be included to reduce the impact pressure of fluid at the drinking holes as the cup is rapidly inverted. For example, FIG. 14 shows a shallow dam wall 100 formed in the lid and extending inward about the drinking holes 34. As the cup is inverted to the shown position by a clockwise rotation, for example, fluid initially impinges on the inside surface of the spout in the direction shown by arrows A and B. Energy from some of the initial flow will be dissipated in the trough 102 formed within the rim 30 of the spout, while some secondary flow energy will be arrested and deflected by dam 100, such that the fluid reaching the inner openings of holes 34 is at a reduced flow energy and less likely to cause leakage.

Figure 15:
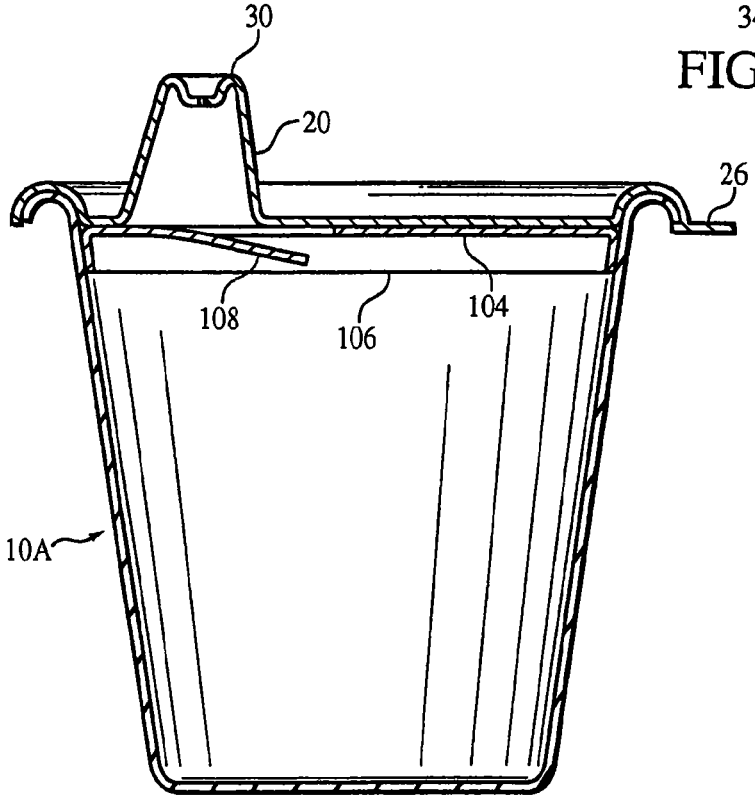
FIG. 15 is a cross-sectional view of a drinking container with a removable baffle plate.

A baffle may also be employed, such as is shown in FIG. 15. Cup 10A has a baffle plate 104 sandwiched between lid 12 and container 14. Baffle plate 104 need not provide any sealing about its periphery, where it engages the inner surface of container 14 along a shallow skirt 106. As lid 12 is snapped into place, its inner surface bears against the upper surface of plate 104, trapping it in place. Baffle plate 104 has an inwardly extending flap 108 underlying spout 20, around which fluid must flow to enter the spout.

Figure 16:
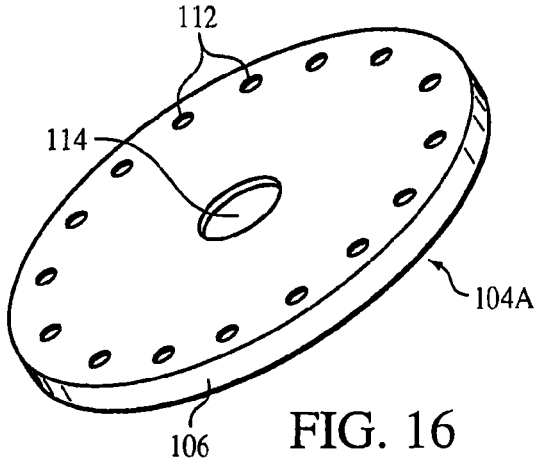
FIG. 16 is a perspective view of a baffle plate with a series of flow holes.

Another baffle plate is shown in FIG. 16. Plate 104A consists essentially of a flat circular plate portion 110 with a shallow depending skirt 106 that tapers in outer diameter to match the inside taper of the container. A series of small flow holes 112 extend through the baffle plate and are spaced apart in a circular pattern so as to ensure that at least one hole 112 is positioned to provide hydraulic communication between the container and the spout without the need for rotational alignment. A larger hole 114 through the center of the plate is large enough to receive a finger for pulling the plate from the container for cleaning.

The drink container may be provided with a shallow step about the perimeter of its inner wall at the opening, to provide a positive stop for the skirt 106 of the baffle plate.

The drinking cup may be configured to take advantage of flow energy to help reduce leakage during cup inversions. By constructing the cup lid to resiliently deform outward under the weight of the contained fluid, a slight vacuum can be created above the fluid, in the enclosed bottom of the cup, thereby reducing the static pressure at the drinking holes.

Figure 17:
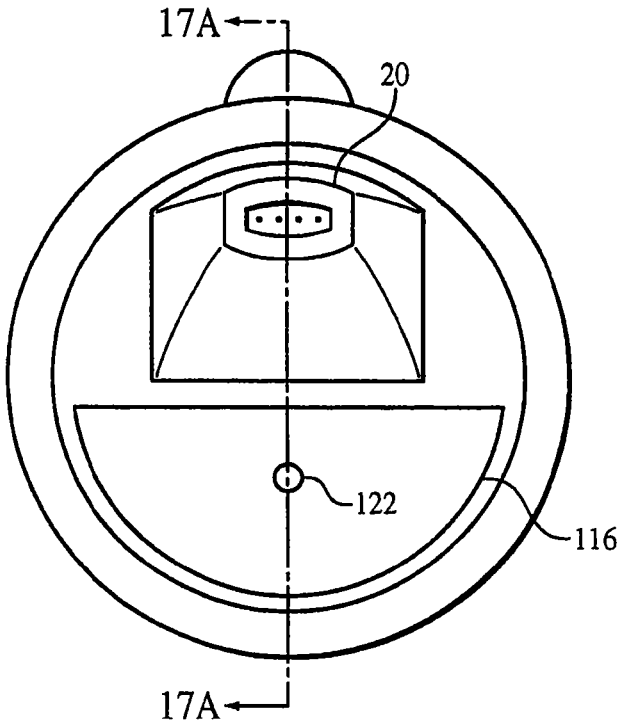
FIG. 17 is a top view of a first lid having a resiliently deformable region.
Figure 17A:
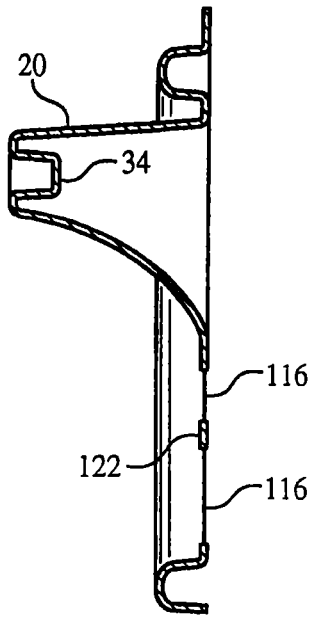
FIG. 17A is a cross-sectional view, taken along line 17A-17A of FIG. 17.

For example, a large area 116 of the planer region of the lid may be molded to have a very thin wall thickness, such as 0.017 inch (0.43 millimeter) or less, as shown in FIGS. 17 and 17A. Outward deformation under pressure can be enhanced by forming at least this expanding region, or the entire lid, of a resilient material. A thin sheet of thermoplastic elastomer (TPE) can be sealed over an aperture of the lid, for example, to form a sealed, expandable bladder.

Figure 18:
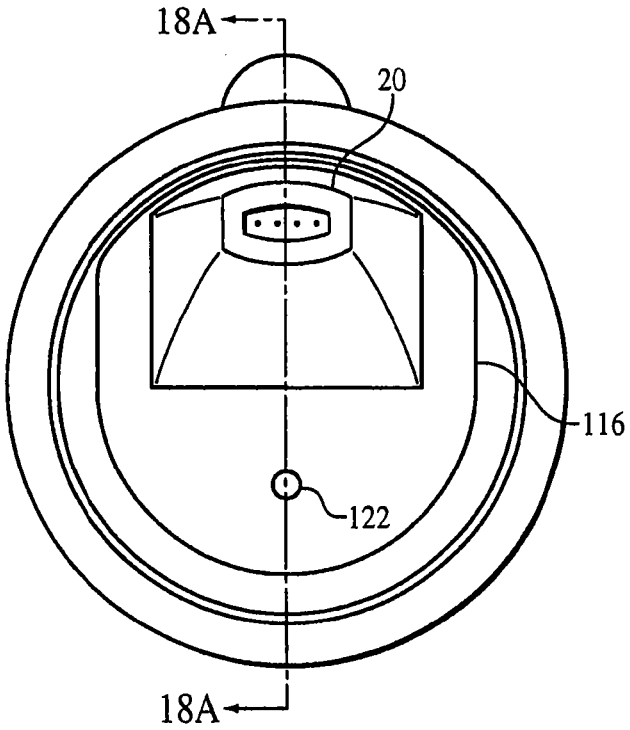
FIG. 18 is a top view of a second lid having a resiliently deformable region.
Figure 18A:
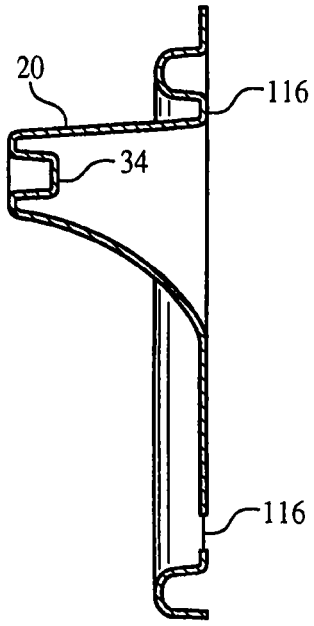
FIG. 18A is a cross-sectional view, taken along line 18A-18A of FIG. 18.

The lid of FIGS. 18 and 18A has a thinned, flexible region 116 extending about the entire spout 20, allowing the more rigid spout to deflect outward slightly under the weight of the cup contents.

Figure 19:
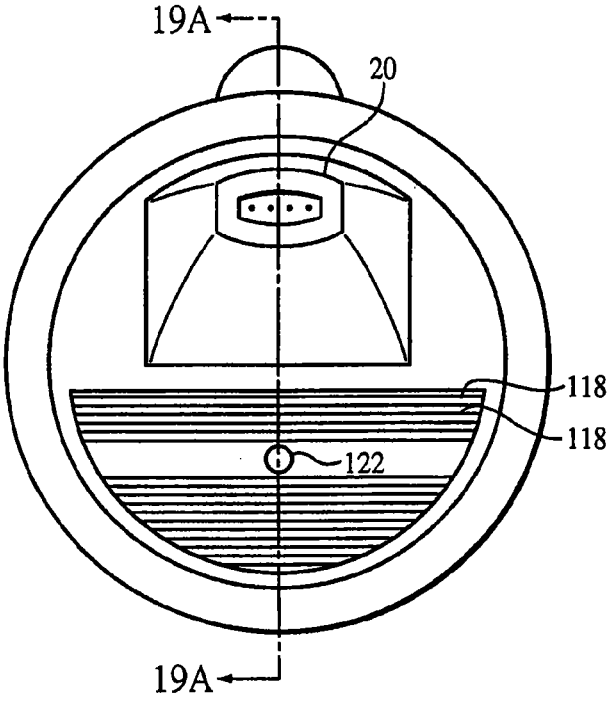
FIG. 19 is a top view of a third lid having a resiliently deformable region.
Figure 19A:
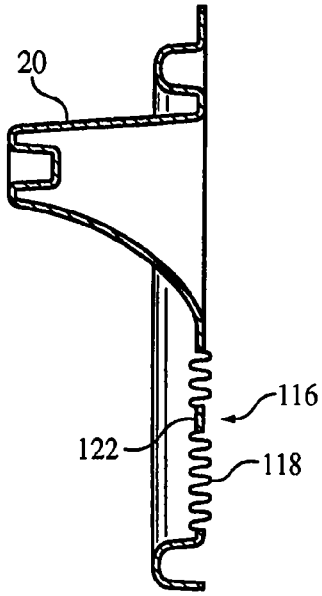
FIG. 19A is a cross-sectional view, taken along line 19A-19A of FIG. 19.
Figure 20:
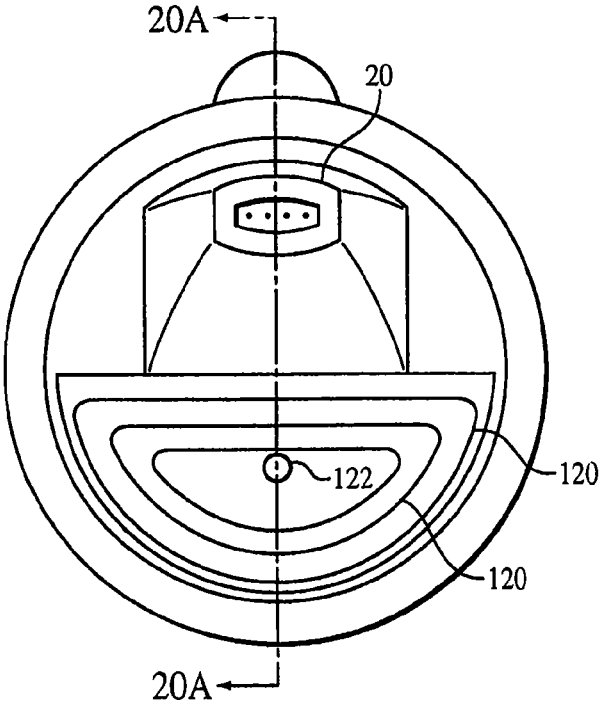
FIG. 20 is a top view of a fourth lid having a resiliently deformable region.
Figure 20A:
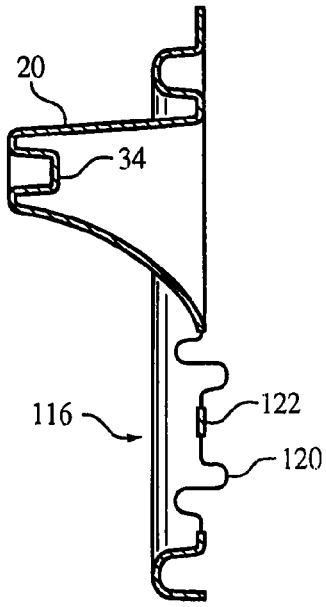
FIG. 20A is a cross-sectional view, taken along line 20A-20A of FIG. 20.

The expandable region 116 of the cup lid may feature non-planer features, such as parallel accordion pleats 118 as shown in FIGS. 19 and 19A, or nested undulations 120 as shown in FIGS. 20 and 20A. In these latter two examples, localized joints or arches elastically flex as adjacent lid portions are pushed outward, increasing cup volume to generate a slight vacuum. It will be realized that for formation of the optimum vacuum, the bottom of the container should remain relatively rigid as the vacuum forms. In each of the last four lid configurations shown, the location of the molding gate is shown as a small circular region 122 of nominal wall thickness.

Figure 21:
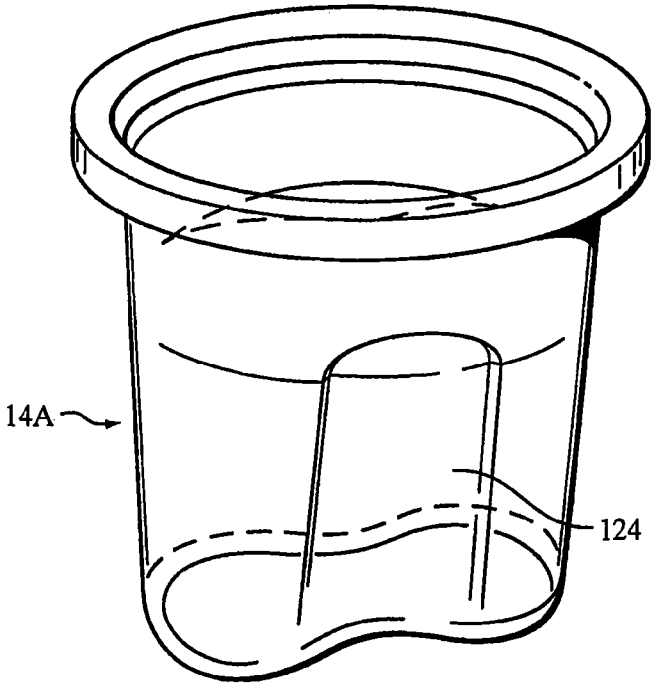
FIG. 21 is a perspective view of a cup body with opposing side indentations.
Figure 21A:
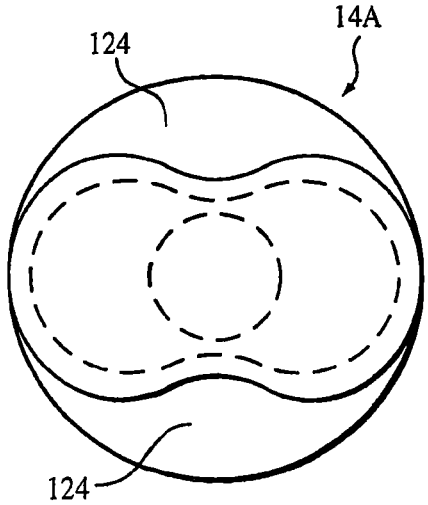
FIG. 21A is a bottom view of the cup body of FIG. 21.
Figure 22:
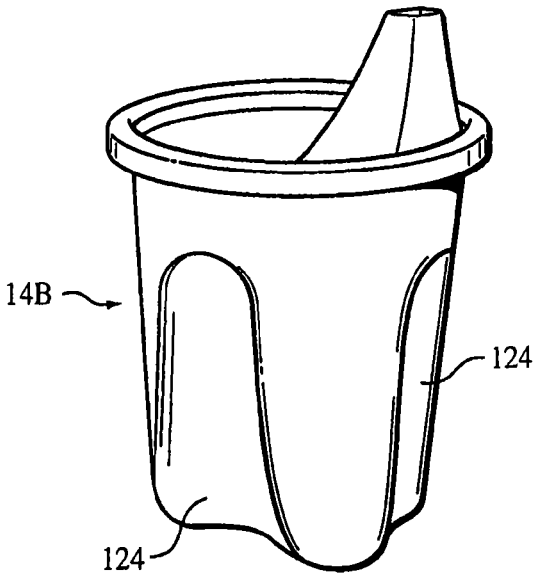
FIG. 22 is a perspective view of a drinking cup with three side indentations.

Although the above containers 14 have been illustrated as of a generally tapered cylindrical shape, other shapes are possible and may enhance graspability by small hands. For example, FIGS. 21 and 21A show a fully nestable container 14A with opposing side indents 124 extending vertically along its lower extent to form a peanut profiled graspable portion. The upper region and rim of the cup are circular for accepting any of the above-described lids. FIG. 22 shows a container 14V with three such indents 124 spaced at 120 degree intervals.

The cups shown in FIGS. 21 and 22 can be sized to hold approximately seven fluid ounces, with enhanced graspability for younger children, and can be fashioned of equal rim diameter to the 10 ounce cup 14 of FIG. 1 for older children.

Although illustrated with respect to a child's sippy cup, aspects of the invention are also applicable to other drinking containers, such as sports bottles and the like. However, particular advantage is obtained in the context of a disposable sippy cup.

A number of embodiments of the invention have been described. Nevertheless, it will be understood that various modifications may be made without departing from the spirit and scope of the invention. Accordingly, other embodiments are within the scope of the following claims.

Various features and advantages of the invention are set forth in the following claims.

What is claimed is:

1. A drinking container comprising:

a main body defining an interior cavity with an opening at an upper end of the main body, the main body having a rim about the upper end; and a removable lid secured to the rim of the main body to enclose the interior cavity and form a seal, the lid having a drinking spout sized to be received within a human mouth, and a plurality of unrestricted apertures formed in the drinking spout providing communication between an exterior of the main body and the interior cavity, the plurality of apertures configured to permit not more than three drops of leakage of potable water from the interior cavity through the apertures over a ten second interval under a quasi-static head of about two vertical inches of potable water over inner ends of the apertures and no vacuum applied to the spout with the container inverted, and to dispense an aggregate of at least 1.3 grams of potable water from the spout over a ten second interval with a steady vacuum of 0.27 Bar below atmospheric pressure applied at outer ends of the apertures and about two vertical inches of potable water over the inner ends of the apertures with the container inverted.

2. The drinking container of claim 1 wherein the lid is integrally and unitarily molded from a resin.

3. The drinking container of claim 2 wherein the lid has a nominal molded thickness of less than about 0.035 inch.

4. The drinking container of claim 3 wherein the lid has a nominal molded thickness of between about 0.020 and 0.026 inch.

5. The drinking container of claim 1 wherein each aperture has a diameter of less than about 0.012 inch.

6. The drinking container of claim 1 wherein both the main body and the lid are each formed of molded resin of a nominal wall thickness of less than about 0.035 inch.

7. The drinking container of claim 6 wherein the nominal wall thickness is less than about 0.025 inch.

8. The drinking container of claim 1 wherein the lid and the main body are integrally and unitarily molded from a resin.

9. The drinking container of claim 1 wherein the seal is air-tight.

10. A drinking container comprising:

a main body defining an interior cavity with an opening at an upper end of the main body, the main body having a rim about the upper end; and a removable lid secured to the rim of the main body to enclose the interior cavity and form a seal, the lid having a drinking spout sized to be received within a human mouth, and a plurality of unrestricted apertures formed in the drinking spout providing communication between an exterior of the main body and the interior cavity, the plurality of apertures configured to permit not more than three drops of leakage of a potable liquid from the interior cavity through the apertures over a ten second interval under a quasi-static head of about two vertical inches of potable liquid over inner ends of the apertures and no vacuum applied to the spout with the container inverted, and to dispense an aggregate of at least 1.3 grams of potable liquid from the spout over a ten second interval with a steady vacuum of 0.27 Bar below atmospheric pressure applied at outer ends of the apertures and about two vertical inches of potable liquid over the inner ends of the apertures with the container inverted.

11. The drinking container of claim 10 wherein the potable liquid is water.

12. The drinking container of claim 10 wherein the potable liquid is fruit juice.

13. The drinking container of claim 10 wherein the potable liquid is whole milk.

14. The drinking container of claim 10 wherein the lid is integrally and unitarily molded from a resin.

15. The drinking container of claim 14 wherein the lid has a nominal molded thickness of less than about 0.035 inch.

16. The drinking container of claim 15 wherein the lid has a nominal molded thickness of between about 0.020 and 0.026 inch.

17. The drinking container of claim 10 wherein each aperture has a diameter of less than about 0.012 inch.

18. The drinking container of claim 10 wherein both the main body and the lid are each formed of molded resin of a nominal wall thickness of less than about 0.035 inch.

19. The drinking container of claim 18 wherein the nominal wall thickness is less than about 0.025 inch.

20. The drinking container of claim 10 wherein the seal is air-tight.

* * * * *